US005932088A

United States Patent [19]

Benazzi et al.

[11] Patent Number: 5,932,088

[45] Date of Patent: Aug. 3, 1999

[54] PROCESS FOR IMPROVING THE POUR POINT OF PARAFFINIC FEEDS USING A CATALYST BASED ON NU-86 ZEOLITE

[75] Inventors: Eric Benazzi, Chatou; Nathalie George-Marchal, Paris, both of France

[73] Assignee: Institut Français du Pétrole, France

[21] Appl. No.: 08/977,739

[22] Filed: Nov. 25, 1997

[30] Foreign Application Priority Data

Nov. 27, 1996 [FR] France ..... 9614627
Nov. 27, 1996 [FR] France ..... 9614628

[51] Int. Cl.[6] ..... C10G 45/64; C10G 45/62

[52] U.S. Cl. ..... 208/27; 208/46; 208/109; 208/110; 208/111; 208/135

[58] Field of Search ..... 208/27, 46, 109, 208/110, 111, 135

[56] References Cited

U.S. PATENT DOCUMENTS 4,574,043 3/1986 Chester et al. ..... 208/59
5,108,579 4/1992 Casci ..... 208/46

FOREIGN PATENT DOCUMENTS 0 463 768 1/1992 European Pat. Off. .

*Primary Examiner*—Walter D. Griffin
*Attorney, Agent, or Firm*—Millen, White, Zelano, & Branigan, P.C.

[57] ABSTRACT

The invention concerns a process for improving the pour point of a feed comprising paraffins containing more than 10 carbon atoms, in which process the feed to be treated is brought into contact with a catalyst comprising NU-86 zeolite, preferably dealuminated, and at least one hydro-dehydrogenating element, at a temperature which is in the range 170° C. to 500° C., a pressure in the range 1 to 250 bar and an hourly space velocity in the range 0.05 to 100 $h^{-1}$, in the presence of hydrogen in a proportion of 50 to 2000 l/l of feed. The product from heavy feeds is fractionated to produce at least one cut including at least one middle distillate with a reduced pour point, and a residue including oil bases with a reduced pour point and a high viscosity index.

22 Claims, No Drawings

PROCESS FOR IMPROVING THE POUR POINT OF PARAFFINIC FEEDS USING A CATALYST BASED ON NU-86 ZEOLITE

FIELD OF THE INVENTION

The present invention concerns a process for improving the pour point of feeds containing linear and/or slightly branched, long (more than 10 carbon atoms) paraffins, to convert feeds with high pour points to at least one cut with a reduced pour point, with good yields. This cut can be a middle distillate and/or an oil base, which thus has a high viscosity index.

PRIOR ART

High quality lubricants are fundamentally important for the proper operation of modem machines, automobiles and trucks. However, the quantity of paraffins originating directly from untreated crude oil with properties which are suitable for use in good lubricants is very low with respect to the increasing demand in this sector.

Heavy oil fractions containing large amounts of linear or slightly branched paraffins must be treated in order to obtain good quality oil bases in the best possible yields, using an operation which aims to eliminate the linear or slightly branched paraffins from feeds which are then used as oil bases or as kerosine or as jet fuel.

High molecular weight paraffins which are linear or very slightly branched which are present in the oils or kerosine or jet fuel result in high pour points and thus to coagulation for low temperature applications. In order to reduce the pour points, such linear paraffins which are not or are only slightly branched must be completely or partially eliminated.

This operation can be carried out by extracting with solvents such as propane or methyl ethyl ketone, termed dewaxing with propane or methyl ethyl ketone (MEK). However, such techniques are expensive, lengthy and not always easy to carry out.

A further technique is selective cracking of the longest linear paraffin chains to form compounds with a lower molecular weight, part of which can be eliminated by distillation.

Because of their form selectivity, zeolites are among the catalysts which are the most used. The idea underlying their use is that zeolitic structures exist which have pore openings which allow long linear or very slightly branched paraffins to enter their micropores but which exclude branched paraffins, naphthenes and aromatic compounds. This phenomenon leads to selective cracking of linear or very slightly branched paraffins.

Zeolite based catalysts with intermediate pore sizes such as ZSM-5, ZSM-11, ZSM-12, ZSM-22, ZSM-23, ZSM-35 and ZSM-38 have been described for their use in such processes.

Processes using some of those zeolites can produce oils by cracking feeds containing less than 50% by weight of linear or linear or very slightly branched is paraffins. However, for feeds containing higher quantities of these compounds, it has become apparent that cracking them using those zeolites leads to the formation of large quantities of light products with low molecular weights such as butane, propane, ethane and methane, which considerably reduces the yield of desired products. Other zeolites (ZSM-22, for example), encourage isomerisation of these compounds and are more suitable for high yield production of oils.

We have concentrated our research on developing an improved process for reducing the pour point using a catalyst based on NU-86 zeolite. This process, applied to heavy cuts, can produce both middle distillates with a reduced pour point and a residue including oil bases with a reduced pour point and high viscosity index.

AIM OF THE INVENTION

The invention provides a process for improving the pour point of a paraffinic feet comprising paraffins containing more than 10 carbon atoms, in which process the feed to be treated is brought into contact with a catalyst comprising NU-86 zeolite and at least one hydro-dehydrogenating element, at a temperature which is in the range 170° C. to 500° C., a pressure in the range 1 to 250 bar and an hourly space velocity in the range 0.05 to 100 $h^{-1}$, in the presence of hydrogen in a proportion of 50 to 2000 l/l of feed. When treating a heavy feed, the product obtained is fractionated so as to obtain at least one cut including at least one middle distillate with a reduced pour point and a residue including oil bases with a reduced pour point and a high viscosity index.

European patent EP-A2-0 463 768 describes NU-86 zeolite in its hydrogen form, designated H-NU-86, obtained by calcining and/or ion exchanging as synthesised NU-86, used in the process of the invention. It also describes its synthesis process, This NU-86 zeolite is characterized by the following X ray diffraction diagram:

X ray diffraction diagram for H—NU-86 zeolite

| $d_{hkl}$ (Å) | $I/I_0$ |
|---|---|
| 11.80 ± 0.15 | m } |
| 11.10 ± 0.15 | w to m } (1) |
| 10.60 ± 0.15 | w to m } |
| 8.60 ± 0.15 | w |
| 4.24 ± 0.10 | w to m |
| 4.16 ± 0.10 | w to m } (2) |
| 4.10 ± 0.10 | w to m } |
| 3.93 ± 0.08 | vs |
| 3.85 ± 0.08 | s to vs |
| 3.73 ± 0.08 | m |
| 3.54 ± 0.06 | w |
| 3.10 ± 0.06 | w |
| 2.07 ± 0.04 | w |

$I/I_0$ represents the relative intensities of the peaks, graduated on the following scale:

w=weak ($I/I_0$ in the range 0 to 20);

m=medium ($I/I_0$ in the range 20 to 40);

s=strong ($I/I_0$ in the range 40 to 60;

vs=very strong ($I/I_0$ in the range 60 to 100).

(1) indicates that the peak is broad and asymmetrical, containing a certain number of peaks, the largest among them being those located at interplanar spacings $d_{hkl}$ of 11.80, 11.10 and 10.60.

(2) indicates that the peak is constituted by a doublet. Nevertheless, in some cases the doublet may not be resolved in the diffractogram and as a result it appears as a single, unresolved peak.

The structural type of this zeolite has not yet been officially attributed by the synthesis commission of the IZA (International Zeolite Association). However, following the work published at the 9th International Zeolite Conference by J. L. Casci, P. A. Box and M. D. Shannon ("Proceedings of the 9th International Zeolite Conference". Montreal 1992, Eds R. Von Ballmoos et al., 1993, Butterworth), it appears that:

NU-86 zeolite has a three dimensional microporous system;

the three-dimensional microporous system is constituted by straight channels with a pore opening which is delimited by 11 T atoms: Si, Al, Ga and Fe), straight channels which are alternately delimited by openings with 10 and with 12 T atoms, and sinusoidal channels which are also alternately delimited by openings with 10 and with 12 T atoms.

The term "pore openings with 10, 11 or 12 tetrahedral atoms (T)" means pores constituted by 10, 11 or 12 sides.

Further, the term "NU-86 zeolite" used in this text means NU-86 zeolites comprising silicon and at least one element T selected from the group formed by Al, Fe, Ga and B, preferably aluminium.

The NU-86 used is preferably dealuminated or more generally, at least a portion of element T has been extracted, and it thus has a global Si/T atomic ratio which is advantageously more than about 20. Element T is preferably extracted from the zeolitic framework (or network) by at least one heat treatment, optionally carried out in the presence of steam, followed by at least one acid attack or by direct acid attack, using at least one solution of a mineral or organic acid.

The global Si/T atomic ratio of the zeolite is preferably more than about 16 and advantageously about 20, preferably more than about 22 and more preferably in the range about 22 to about 300, or about 250.

The "dealuminated" NU-86 zeolite is at least partially, or practically completely, in its acid form, i.e., in its hydrogen ($H^+$) form. The Na/T atomic ratio is generally less than 0.7%, preferably less than 0.6% and more preferably less than 0.4%.

The process can advantageously convert a feed with a high pour point to a product with a lower pour point. It can be a middle distillate cut with a reduced pour point (for example gas oils) and/or an oil base with a reduced pour point and a high viscosity index.

The feed is composed, among others, of linear and/or slightly branched paraffins containing at least 10 carbon atoms, preferably 15 to 20 carbon atoms, and advantageously 15 to 40 carbon atoms.

One advantage of a catalyst comprising a NU-86 molecular sieve is that it does not result in the formation of too many light products.

Further, the catalyst comprises at least one hydro-dehydrogenating function, for example a group VIII metal or a combination of at least one group VIII metal or compound and at least one group VI metal or compound, and the reaction is carried out under conditions which will be described below.

Using the NU-86 zeolite in accordance with the invention under the conditions which will be described below can produce products with a low pour point and products with a high viscosity index, in good yields.

DETAILED DESCRIPTION OF THE INVENTION

The NU-86 zeolite has an Si/T atomic ratio (Al preferred) in the range 8 to 1000, in particular in the range 8.5 to 16 for zeolites obtained by synthesis, and a Si/T atomic ratio of more than 16, advantageously more than 20, for zeolites in which at least a portion of element T has been extracted.

The dealuminated NU-86 zeolite of the invention, in the preferred case where T is Al, can be prepared by two methods from as synthesised NU-86 zeolite containing an organic structuring agent. These methods are described below. However, any other method which is known to the skilled person can also be used, also any suitable method when T is other than Al.

The first method, direct acid attack, comprises a first calcining step carried out in dry air, at a temperature which is generally in the range 450° C. to 550° C., which eliminates the organic structuring agent present in the micropores of the zeolite, followed by a step in which the zeolite is treated with an aqueous solution of a mineral acid such as $HNO_3$ or HCl or an organic acid such as $CH_3CO_2H$. This latter step can be repeated as many times as is necessary to obtain the desired degree of dealumination. Between these two steps, one or more ion exchange steps can be carried out using at least one $NH_4NO_3$ solution, to at least partially and preferably almost completely eliminate the alkaline cation, in particular sodium. Similarly, at the end of the direct acid attack dealumination step, one or more optional ion exchange steps can be carried out using at least one $NH_4NO_3$ solution to eliminate residual alkaline cations, in particular sodium.

In order to obtain the desired Si/Al ratio, the operating conditions must be correctly selected; the most critical parameters in this respect are the temperature of the treatment with the aqueous acid solution, the concentration of the latter, its nature, the ratio between the quantity of acid solution and the mass of the treated zeolite, the treatment period and the number of treatments carried out.

The second method, heat treatment (in particular using steam, by steaming)+acid attack, comprises firstly calcining in dry air at a temperature which is generally in the range 450° C. to 550° C., to eliminate the organic structuring agent occluded in the micropores of the zeolite. The solid obtained then undergoes one or more ion exchanges using at least one $NH_4NO_3$ solution, to eliminate at least a portion, preferably practically all of the alkaline cation, in particular sodium, present in the cationic position of the zeolite. The zeolite obtained then undergoes at least one framework dealumination cycle comprising at least one heat treatment which is optionally and preferably carried out in the presence of steam, at a temperature which is generally in the range 550° C. to 900° C., and optionally followed by at least one acid attack using an aqueous solution of a mineral or organic acid. The conditions for calcining in the presence of steam (temperature, steam pressure and treatment period), also the post-calcining acid attack conditions (attack period, concentration of acid, nature of acid used and the ratio between the volume of the acid and the mass of zeolite) are adapted so as to obtain the desired level of dealumination. For the sane reason, the number of heat treatment-acid attack cycles can be varied.

In the preferred case when T is Al, the framework dealumination cycle, comprising at least one heat treatment step, optionally and preferably carried out in the presence of steam, and at least one attack step carried out in an acid medium of the NU-86 zeolite, can be repeated as often as is necessary to obtain the dealuminated NU-86 zeolite having the desired characteristics. Similarly, following the heat treatment, optionally and preferably carried out in the presence of steam, a number of successive acid attacks can be carried out using different acid concentrations.

In a variation of this second calcining method, heat treatment of the NU-86 zeolite containing the organic structuring agent can be carried out at a temperature which is generally in the range 550° C. to 850° C., optionally and preferably in the presence of steam. In this case, the steps of calcining the organic structuring agent and dealumination of the framework are carried out simultaneously. The zeolite is then optionally treated with at least one aqueous solution of a mineral acid (for example $HNO_3$ or HCl) or an organic acid (for example $CH_3CO_2H$). Finally, the solid obtained can optionally undergo at least one ion exchange step using at least one $NH_4NO_3$ solution, to eliminate practically all of the alkaline cations, in particular sodium, present in the cationic position in the zeolite.

The sieve (NU-86 zeolite) generally contains at least one hydro-dehydrogenating element, for example at least one group VIII element, preferably a noble metal, advantageously selected from the group formed by Pt or Pd, which is introduced into the molecular sieve by dry impregnation, or ion exchange, for example, or by any other method which is known to the skilled person.

The amount of metal thus introduced, expressed as weight % with respect to the mass of molecular sieve engaged, is generally less than 5%, preferably less than 3% and generally of the order of 0.5% to 1% by weight.

When treating a real feed, the molecular sieve of the invention is first formed. In a first variation, the molecular sieve can have at least one group VIII metal deposited on it, preferably selected from the group formed by platinum and palladium, and can be formed by any technique which is known to the skilled person. In particular, it can be mixed with a matrix, which is generally amorphous, for example a moist alumina gel powder. The mixture is then formed, for example by extrusion through a die. The amount of molecular sieve in the mixture obtained is generally in the range 0.5% to 99.9%, advantageously in the range 5% to 90% by weight, with respect to the mixture (molecular sieve+matrix).

In the remaining text, the term "support" is used to describe the molecular sieve+matrix mixture.

Forming can be carried out with matrices other than alumina, such as magnesia, amorphous silica-aluminas, natural clays (kaolin, bentonite, sepiolite, attapulgite), silica, titanium oxide, boron oxide, zirconia, aluminium phosphates, titanium phosphates, zirconium phosphates, charcoal and mixtures thereof. Techniques other than extrusion, such as pelletization or bowl granulation, can be used.

The group VIII hydrogenating metal, preferably Pt and/or Pd, can also be deposited on the support using any process which is known to the skilled person which can deposit metal on the molecular sieve. Competitive cation exchange can be used, with ammonium nitrate as the preferred competitor, the competition ratio being at least about 20 and advantageously about 30 to 200. When platinum or palladium is used, a platinum tetramine complex or a palladium tetramine complex is normally used: these latter are almost completely deposited on the molecular sieve. This cation exchange technique can also be used to deposit the metal directly on powdered molecular sieve before mixing it with any matrix.

Deposition of the group VIII metal(s) is generally followed by calcining in air or oxygen, usually between 300° C. and 600° C. for 0.5 to 10 hours, preferably between 350° C. and 550° C. for 1 to 4 hours. Reduction in hydrogen can then follow, generally at a temperature which is in the range 300° C. to 600° C. for 1 to 10 hours, preferably in the range 350° C. to 550° C. for 2 to 5 hours.

The platinum and/or palladium can also be deposited not directly on the molecular sieve, but on the matrix (alumina binder) before or after forming, by anion exchange with hexachloroplatinic acid, hexachloropalladic acid and/or palladium chloride in the presence of a competitive agent, for example hydrochloric acid. As before, after depositing the platinum and/or palladium, the catalyst is generally calcined then reduced in hydrogen as indicated above.

The hydro-dehydrogenating element can also be a combination of at least one group VI metal or compound (for example molybdenum or tungsten) and at least one group VIII metal or compound (for example nickel or cobalt). The total concentration of group VI and group VIII metals, expressed as the metal oxides with respect to the support, is generally in the range 5% to 40% by weight, preferably in the range 7% to 30% by weight. The weight ratio (expressed as the metallic oxides) of group VIII metals to group VI metals is preferably in the range 0.05 to 0.8: more preferably in the range 0.13 to 0.5.

The above preparation methods can be used to deposit these metals.

This type of catalyst can advantageously contain phosphorous, the content of which is generally less than 15% by weight, preferably less than 10% by weight, expressed as phosphorous oxide $P_2O_5$ with respect to the support.

Feeds which can be treated using the process of the invention are advantageously fractions with relatively high pour points which are to be reduced.

The process of the invention can be used to treat a variety of feeds from relatively light fractions, such as kerosines and jet fuels, to feeds with higher boiling points such as middle distillates, vacuum residues or gas oils.

The feed to be treated is, for the most part, a $C_{10}^+$ cut with an initial boiling point of more than about 175° C., preferably a cut with an initial boiling point of at least 280° C. For oil production, heavy feeds are used, i.e., those which are at least 80% by volume constituted by compounds with boiling points of at least 350° C., preferably 350–580° C., and advantageously at least 380° C. The process of the invention is particularly suitable for the treatment of paraffinic distillates such as middle distillates which encompass gas oils, kerosines and jet fuels, for the treatment of vacuum residues and all other fractions with a pour point and viscosity which must be adapted to satisfy specifications, including, for example, middle distillates from FCC (LCO and HCO) and hydrocracking residues.

Feeds which can be treated using the process of the invention can contain paraffins, olefins, naphthenes, aromatics and heterocycles and have a high proportion of high molecular weight n-paraffins and very slightly branched paraffins, also of high molecular weight.

Typical feeds which can advantageously be treated by the process of the invention generally have a pour point of more than 0° C. The products resulting from treatment in accordance with the process have pour points of below 0° C., preferably below about −10° C.

The amounts of n-paraffins containing more than 10 carbon atoms, with high molecular weight, and only very slightly branched paraffins containing more than 10 carbon atoms, also with high molecular weight, is over 30% and up to about 90%, and in some cases more than 90% by weight. The process is of particular interest when this proportion is at least 60% by weight.

Non limiting examples of other feeds which can be treated in accordance with the invention are bases for lubricating oils, synthesised paraffins from the Fischer-Tropsch process, high pour point polyalphaolefins, synthesised oils, etc. . . . The process can also be applied to other compounds containing an n-alkane chain such as those defined above, for example n-alkylcycoalkanes, or containing at least one aromatic group.

The process is carried out under the following operating conditions:

the reaction temperature is in the range 170° C. to 500° C., preferably in the range 180° C. to 470° C., advantageously 190° C. to 450° C.;

the pressure is in the range 1 to 250 bar, preferably in the range 10 to 200 bar;

the hourly space velocity (HSV expressed as the volume of feed injected per unit volume of catalyst per hour) is in the range about 0.05 to about 100, preferably about 0.1 to about 30 $h^{-1}$.

The feed and the catalyst are brought into contact in the presence of hydrogen. The amount of hydrogen used, expressed in liters of hydrogen per liter of feed, is in the range 50 to about 2000 liters of hydrogen per liter of feed, preferably in the range 100 to 1500 liters of hydrogen per liter of feed.

The quantity of nitrogen compounds in the feed to be treated is preferably less than about 200 ppm by weight, more preferably less than 100 ppm by weight. The sulphur content is below 1000 ppm by weight, preferably less than 500 ppm, more preferably less than 200 ppm by weight. The quantity of metals in the feed, such as Ni or V, is extremely low, i.e., less tan 50 ppm by weight, preferably less than 10 ppm by weight and more preferably less than 2 ppm by weight.

When a heavy feed is treated to produce an oil base, the product obtained after treating the heavy feed with the NU-86 zeolite based catalyst is fractionated into at least one cut including at least one middle distillate with a reduced pour point, and into a residue including oil bases with a reduced pour point and a high viscosity index.

The middle distillate can be a kerosine (the cut generally has boiling points of 150° C.–less than 250° C.), a gas oil (heavier cut than kerosine, generally at least 250° C. to less than 400 ° C., or less than 380° C). The oil is thus in the 380+ or 400+ residue, the cut points can vary to some extent depending on operative constraints.

The following examples illustrate the invention without limiting its scope.

EXAMPLE 1

The starting material was a NU-86 zeolite prepared in accordance with Example 2 of EP-A2-0 463 768 with a global Si/Al atomic ratio of 10.2, and a Na/Al atomic ratio of 0.25.

This NU-86 zeolite first underwent dry calcining at 550° C. in a steam of dry air for 9 hours. The solid obtained underwent four ion exchange steps in a solution of 10 N $NH_4NO_3$ at about 100° C. for 4 hours for each exchange step. The solid obtained was designated as $NH_4$-NU-86/1 and had an Si/Al ratio of 10.4 and an Na/Al ratio of 0.013. The remaining physico-chemical characteristics are shown in Table 1.

The values were determined as follows:

For each sample, the total surface area of the signal over an angular range (2) of 6° to 40° is measured from the X ray diffraction diagrams, then for the same zone, the surface area of the peaks as the number of pulses for a stepwise 3 second recording with a step size of 0.02° (2) was measured. The ratio of these two values, surface area of peaks/total surface area, is characteristic of the quantity of crystalline material in the sample. This ratio or "peak ratio" is then compared for each sample with the peak ratio of a reference sample which is arbitrarily considered to be completely (100%) crystalline. The degree of crystallinity is then expressed as a percentage with respect to a reference, which must be carefully selected, as the relative intensity of the peaks varies depending on the nature, the proportion and position of the different atoms in the structure unit, in particular the cations and the structuring agent. For the examples of the present description, the reference selected is the form of NU-86 which had been calcined in dry air and exchanged three times in succession with an ammonium nitrate solution.

The microporous volume can also be estimated from the quantity of nitrogen adsorbed at 77 K for a partial pressure $P/P_0$ of 0.19, for example.

TABLE 1

| Sample | X ray diffraction Crystallinity (%) | Adsorption $S_{BET}$ ($m^2/g$) | Adsorption $V(P/P_0 = 0.19)$ ml liquid $N_2/g$ |
|---|---|---|---|
| $NH_4$—NU-86/1 | 100 | 423 | 0.162 |

The NU-86 zeolite crystallites were in the form of crystals with a size of 0.4 $\mu$m to 2 $\mu$m.

The $NH_4$-NU-86/1 zeolite was mixed with SB3 type alumina from Condéa. The mixed paste was extruded through a 1.2 mm die. The extrudates were then calcined at 500° C. for 2 hours in air then dry impregnated with a solution of platinum tetramine chloride $[Pt(NH_3)_4]Cl_2$, and finally calcined in air at 550° C. The platinum content in the final catalyst Cl was 0.7% by weight and the zeolite content expressed with respect to the ensemble of the catalyst mass was 20% by weight.

EXAMPLE 2

Evaluation of Catalyst C1 with a Hydrocracking Residue

Catalyst C1 was evaluated by treating a hydrocracking residue from a vacuum distillate.

The feed had the following characteristics:

| | |
|---|---|
| Sulphur content (ppm by weight) | 10 |
| Nitrogen content (ppm by weight) | 1 |
| Pour point (° C.) | +40 |
| Initial boiling point | 281 |
| 10% | 345 |
| 50% | 412 |
| 90% | 470 |
| End point | 543 |

Catalyst C1, the preparation of which was described in Example 1, was used to prepare an oil base from the feed described above.

The catalyst had been reduced, in situ in the reactor, in hydrogen at 450° C. before the catalytic test. This reduction was carried out in stages. It consisted of a stage at 150° C. for 2 hours, then an increase of the temperature to 450° C. at a rate of 1° C./min, then a stage of 2 hours at 450° C. During this reduction procedure, the hydrogen flow rate was 1000 liters of $H_2$ per liter of catalyst.

The reaction was carried out at 265° C., at a total pressure of 12 MPa, an hourly space velocity of 2 $h^{-1}$ and a hydrogen flow rate of 1000 liters of $H_2$ per liter of feed. Fractionating the effluent allowed an oil base to be recovered as a residue, also a middle distillate cut with a boiling point of 150–400° C. (400° C. excluded) and light products. Under these operating conditions, the net conversion of $400^-$ compounds (with a boiling point of less than 400° C.) was 25% by weight and the oil base yield was 75% by weight.

The characteristics of the oil obtained are given in the following table.

| | |
|---|---|
| Viscosity index VI | 132 |
| Pour point | −12° C. |
| Oil yield (weight %) | 75 |

The pour point of the gas oil was −33° C.

This example demonstrates the importance of using a catalyst in accordance with the invention, which can reduce the pour point of the initial feed, in this case a hydrocracking residue, while preserving a high viscosity index (VI).

EXAMPLE 3

The zeolite of Example 1 was used

This NU-86 zeolite first underwent dry calcining at 550° C. in a stream of dry air for 9 hours. The solid obtained underwent four ion exchange steps in a solution of 10 N $NH_4NO_3$ at about 100° C. for 4 hours for each exchange step. The solid obtained was designated as $NH_4$-NU-86 and had an Si/Al ratio of 10.4 and an Na/Al ratio of 0.013. The remaining physico-chemical characteristics are shown in Table 1. The NU-86 zeolite then underwent treatment with a 6N nitric acid solution at about 100° C. for 5 hours. The volume V of the nitric acid solution used (in ml) equalled 10 times the weight W of the NU-86 zeolite used (V/W=10).

Following these treatments, the zeolite obtained was designated as $NH_4$-NU-86/2. It had a global Si/Al atomic ratio of 34, and a Na/Al atomic ratio of 0.005. These crystallographic and adsorption characteristics are shown in Table 2 below.

TABLE 2

| | | Adsorption | |
|---|---|---|---|
| Sample | X ray diffraction Crystallinity (%) | $S_{BET}$ ($m^2/g$) | $V(P/P_0 = 0.19)$ ml liquid $N_2/g$ |
| $NH_4$—NU-86/2 | 99 | 458 | 0.180 |

The zeolite was mixed with SB3 type alumina from Condéa. The mixed paste was extruded through a 1.2 mm die. The extrudates were then calcined at 500° C. for 2 hours in air then dry impregnated with a solution of platinum tetramine chloride $[Pt(NH_3)_4]Cl_2$, and finally calcined in air at 550° C. The platinum content in the final catalyst was 0.7% by weight and the zeolite content expressed with respect to the ensemble of the catalyst mass was 30% by weight.

EXAMPLE 4

The catalyst was evaluated by treating a hydrocracking residue from a vacuum distillate to prepare an oil base.

The feed had the following characteristics:

| | |
|---|---|
| Sulphur content (ppm by weight) | 10 |
| Nitrogen content (ppm by weight) | 1 |
| Pour point (° C.) | +40 |
| Initial boiling point | 281 |
| 10% | 345 |
| 50% | 412 |
| 90% | 470 |
| End point | 543 |

The catalyst had been reduced, in situ in the reactor, in hydrogen at 450° C. before the catalytic test. This reduction was carried out in stages. It consisted of a stage at 150° C. for 2 hours, then an increase of the temperature to 450° C. at a rate of 1° C./min, then a stage of 2 hours at 450° C. During this reduction procedure, the hydrogen flow rate was 1000 liters of $H_2$ per liter of catalyst.

The reaction was carried out at 300° C., at a total pressure of 12 MPa, an hourly space velocity of 1.8 $h^{-1}$ and a hydrogen flow rate of 1000 liters of $H_2$ per liter of feed. Under these operating conditions, the net conversion of $400^-$ compounds was 27% by weight and the oil base yield was 73% by weight.

The characteristics of the oil obtained are given in the following table.

| | |
|---|---|
| Viscosity index VI | 134 |
| Pour point (° C.) | −16 |
| Oil Yield (weight %) | 73 |

This example demonstrates the importance of using a catalyst in accordance with the invention, which can reduce the pour point of the initial feed, in the case of a hydrocracking residue, while preserving a high viscosity index (VI).

We claim:

1. A process for improving the pour point of a feed comprising paraffins containing more than 10 carbon atoms, in which process the feed to be treated is brought into contact with a catalyst comprising NU-86 zeolite and at least one hydro-dehydrogenating element, at a temperature which is in the range of 170° C. to 500° C., a pressure in the range 1 to 250 bar and at an hourly space velocity in the range 0.05 to 100 $h^{-1}$, in the presence of hydrogen in a proportion of 50 to 2000 l/l of feed.

2. A process according to claim 1, in which the NU-86 zeolite comprises silicon and at least one element T selected from the group consisting of aluminium, iron, gallium and boron, from which at least a portion of element T has been extracted, and with a global Si/T atomic ratio of more than 20.

3. A process according to claim 1, in which the hydro-dehydrogenating element is in group VIII.

4. A process according to claim 1, in which hydro-dehydrogenating element is a combination of at least one group VI metal or compound and at least one group VIII metal or compound.

5. A process according to claim 2, in which element T is aluminium.

6. A process according to claim 2, in which the Si/T molar ratio is more than 22.

7. A process according to claim 2, in which the Si/T molar ratio is in the range 22 to 300.

8. A process to claim 2, in which the zeolite is partially in its acid form.

9. A process according to claim 1, in which the catalyst contains at least one matrix selected from the group consisting of clays, magnesia, alumina, silica, titanium oxide, boron oxide, zirconia, aluminium phosphates, titanium phosphates, zirconium phosphates, silica-aluminas, and charcoal.

10. A process according to claim 1, in which the catalyst has a zeolite content which is in the range 0.5% to 99.9% by weight.

11. A process according to claim 1, in which the initial boiling point of the feed is more than 175° C.

12. A process according to claim 1, in which the initial boiling point of the feed is at least 280° C.

13. A process according to claim 1, in which at least 80% by volume of the feed is constituted by compounds with a boiling point of at least 350° C.

14. A process according to claim 1, in which the feed to be treated is present in a hydrocarbon feed selected from the group consisting of kerosines, jet fuels, gas oils, vacuum residues, hydrocracking residues, paraffins from the Fischer-Tropsch process, synthesised oils, FCC middle distillates, oil bases, and polyalphaolefins.

15. A process according to claim 13, in which the product obtained, after treating the heavy feed with the NU-86 zeolite based catalyst, is fractionated into at least one cut including at least one middle distillate with a reduced pour point, and into a residue including oil bases with a reduced pour point and a high viscosity index.

16. A process according to claim 15, in which the NU-86 zeolite comprises silicon and aluminum, from which at least a portion of aluminum has been extracted so as to provide a global Si/Al atomic ratio of more than 20 and in which the zeolite is at least partially in its acid form, to achieve a pour point less than the pour point achievable with the same catalyst which has not been modified to extract aluminum.

17. A process according to claim 13, in which the product obtained, after treating the feed with the NU-86 zeolite based catalyst, is fractionated into at least one cut including at least one middle distillate with a reduced pour point, and into a residue including oil bases with a reduced pour point and a high viscosity index and with an oil yield on a weight basis of at least about 73%.

18. A process according to claim 1, wherein said catalyst further comprises $P_2O_5$.

19. A process for improving the pour point of a feed having a pour point about 0° C. and comprising paraffins containing more than ten carbon atoms and in which at least 80% by volume of the feed is constituted by compounds having a boiling point of at least 350° C., said process comprising contacting the feed with a catalyst comprising NU-86 zeolite and at least one of platinum and palladium, at a temperature of 170–500° C., a pressure of 1 to 250 bar, an hourly space velocity in the range of 0.05 to 100 $h^{-1}$ in the presence of hydrogen in a proportion of 50 to 2,000 l/l of feed, to reduce the pour point to below 0° C.

20. A process according to claim 19, in which the product obtained, after treating the feed with the NU-86 zeolite based catalyst, is fractionated into at least one cut including at least one middle distillate with a reduced pour point, and into a residue including oil bases with a reduced pour point and a high viscosity index and with an oil yield on a weight basis of at least about 73%.

21. A process according to claim 19, wherein said catalyst further comprises $P_2O_5$.

22. A process according to claim 19, wherein said catalyst further comprises $P_2O_5$.

* * * * *